US008651869B1

(12) United States Patent
Lassalle

(10) Patent No.: US 8,651,869 B1
(45) Date of Patent: Feb. 18, 2014

(54) EDUCATIONAL GAME

(76) Inventor: Angel L. Lassalle, Reseda, CA (US)

( * ) Notice: Subject to any disclaimer, the term of this patent is extended or adjusted under 35 U.S.C. 154(b) by 194 days.

(21) Appl. No.: 13/308,808

(22) Filed: Dec. 1, 2011

(51) Int. Cl.
*G09B 19/22* (2006.01)

(52) U.S. Cl.
USPC ..... 434/128

(58) Field of Classification Search
USPC ..... 434/128, 129; 273/146, 243, 262, 292, 273/293, 297, 299, 302, 307, 308
See application file for complete search history.

(56) References Cited

U.S. PATENT DOCUMENTS

| | | | | |
|---|---|---|---|---|
| 1,855,543 | A | 4/1932 | Dalton | |
| D301,556 | S | 6/1989 | Okada | |
| 6,435,508 | B1 * | 8/2002 | Tavel | 273/292 |
| 7,118,107 | B2 * | 10/2006 | Niedner et al. | 273/236 |
| 7,144,013 | B2 * | 12/2006 | Tanaka | 273/308 |
| 7,392,986 | B2 * | 7/2008 | Gress | 273/292 |
| 7,469,901 | B1 * | 12/2008 | Hilliard | 273/308 |
| 8,181,963 | B2 * | 5/2012 | Gress | 273/292 |
| 8,221,124 | B2 * | 7/2012 | Ferguson et al. | 434/128 |
| 8,448,947 | B2 * | 5/2013 | McAndrew et al. | 273/288 |
| 2002/0043764 | A1 | 4/2002 | Imhof | |
| 2006/0033273 | A1 * | 2/2006 | Borne et al. | 273/243 |
| 2006/0220317 | A1 | 10/2006 | Edwards | |
| 2006/0284373 | A1 * | 12/2006 | Kenney et al. | 273/243 |
| 2008/0099990 | A1 * | 5/2008 | Wittig | 273/243 |
| 2009/0295092 | A1 | 12/2009 | Kuneman | |
| 2010/0003649 | A1 | 1/2010 | Ferguson et al. | |

* cited by examiner

*Primary Examiner* — Kurt Fernstrom

(57) ABSTRACT

A game having two numerical dice, each numerical die having ten faces, each face labeled with a number such that each numerical die has a face labeled with each 0, 1, 2, 3, 4, 5, 6, 7, 8, and 9; two symbol dice, each symbol die having ten faces, each face labeled with a symbol; a plurality of creature cards forming a first deck of cards, each creature card has a front face labeled with at least a picture, a name, a card type, a rarity, an ability, and a spell symbol; and a plurality of spell cards forming a second deck of cards, each spell card has a front face labeled with at least a picture, a name, an ability, a series symbol matching one symbol on the symbol dice, an attack, and a defense.

2 Claims, 3 Drawing Sheets

(ISO View)

(ISO View)

(ISO View)

(ISO View)

(Spell Card)

(Creatures Card)

(Top & Bottom View)

(Top View)

EDUCATIONAL GAME

FIELD OF THE INVENTION

The present invention is directed to a novel educational game for teaching children multiple subject matters, for example multiplication tables, vocabulary, and reading comprehension.

BACKGROUND OF THE INVENTION

Many educational games exist, however oftentimes such games target only one subject matter. The present invention features a novel educational game. The game of the present invention helps children learn educational concepts in an interactive way. For example, it can be used to help children learn their multiplication tables and other subject matters. The game of the present invention is adaptable to all subject matters. The illustrations and pictures are colorful, and the storyline is unique, helping promote vocabulary development and reading comprehension.

SUMMARY

The present invention features an educational game. In some embodiments, the game comprises two numerical dice, each numerical die having ten faces, each face labeled with a number such that each numerical die has a face labeled with each 0, 1, 2, 3, 4, 5, 6, 7, 8, and 9; two symbol dice, each symbol die having ten faces, each face labeled with a symbol; a plurality of creature cards forming a first deck of cards, each creature card has a front face labeled with at least a picture, a name, a card type, a rarity, an ability, and a spell symbol; and a plurality of spell cards forming a second deck of cards, each spell card has a front face labeled with at least a picture, a name, an ability, a series symbol matching one symbol on the symbol dice, an attack, and a defense.

In some embodiments, the symbol is selected from the group consisting of an infinity symbol, a positive symbol, a negative symbol, an omega symbol, and a unique symbol.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIG. 1-5, the present invention features a novel educational and role playing game 100. The game 100 comprises two numerical dice 110. Each numerical die 110 has ten faces, and each face is labeled with a number such that each numerical die has a face labeled with each 0, 1, 2, 3, 4, 5, 6, 7, 8, and 9.

Figure 1:
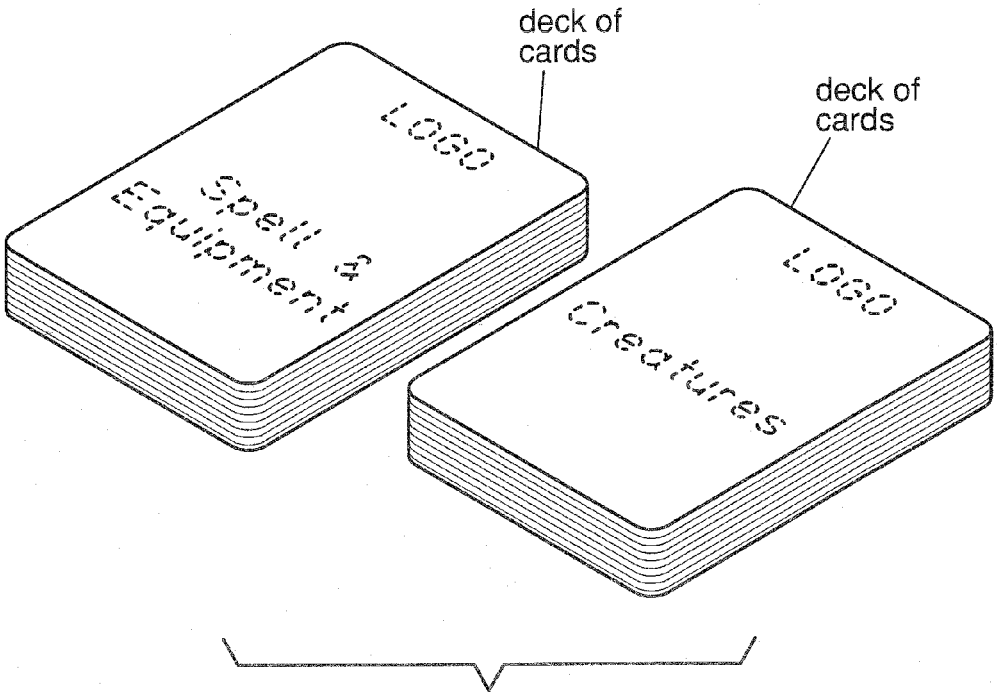
FIG. 1 is a perspective view of the decks of cards of the game of the present invention.
Figure 2:
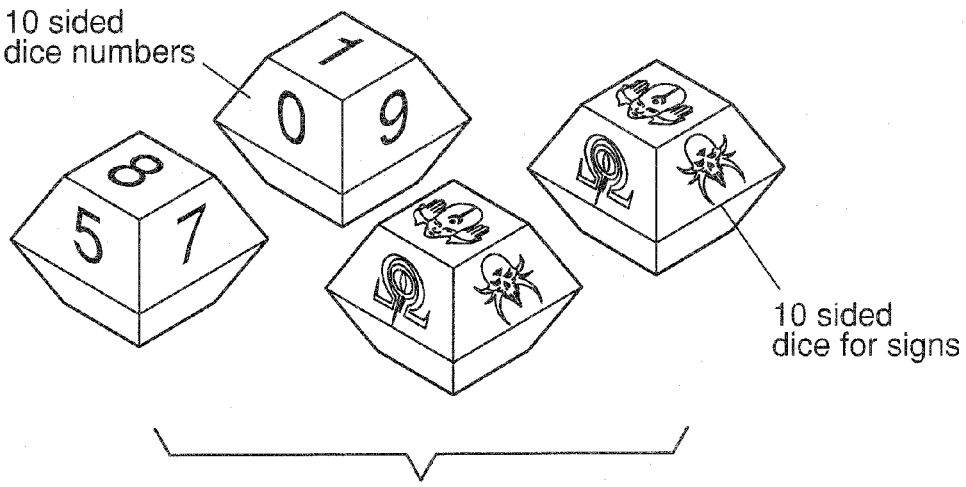
FIG. 2 is a perspective view of the dice of the game of the present invention.
Figure 6:
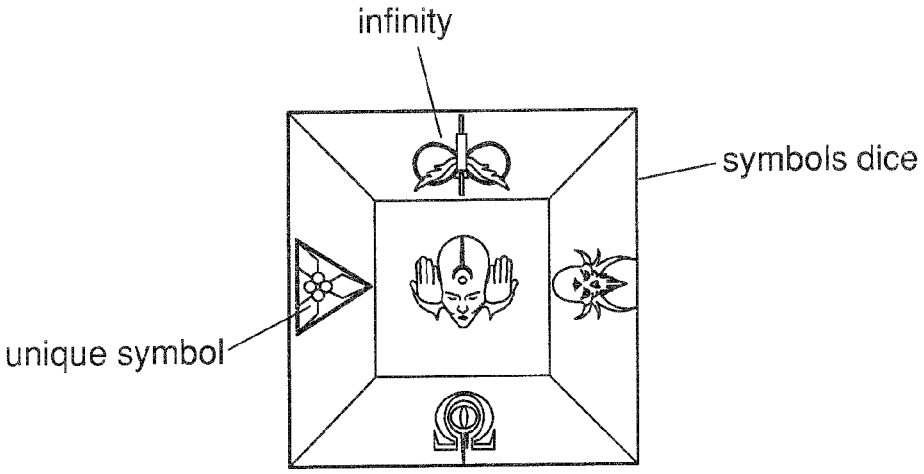
FIG. 6 is a detailed view of a symbol die of the present invention.

The game 100 further comprises two symbol dice 210. Each symbol die 210 has ten faces, wherein each face is labeled with a symbol. Examples of the symbols are shown in FIG. 2 and in FIG. 6. For example, a first symbol is an infinity symbol, a second symbol is a positive symbol, a third symbol is a negative symbol, a fourth symbol is an omega symbol, and a fifth symbol is a unique symbol. In some embodiments, each of the five symbols appears twice on each symbol die 210.

Figure 4:
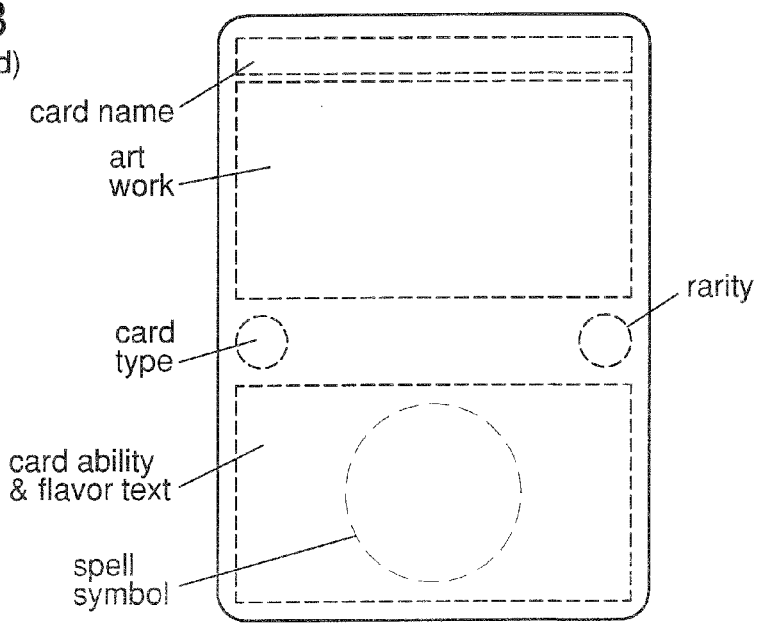
FIG. 4 is a detailed view of a creatures card of the game of the present invention.
Figure 5:
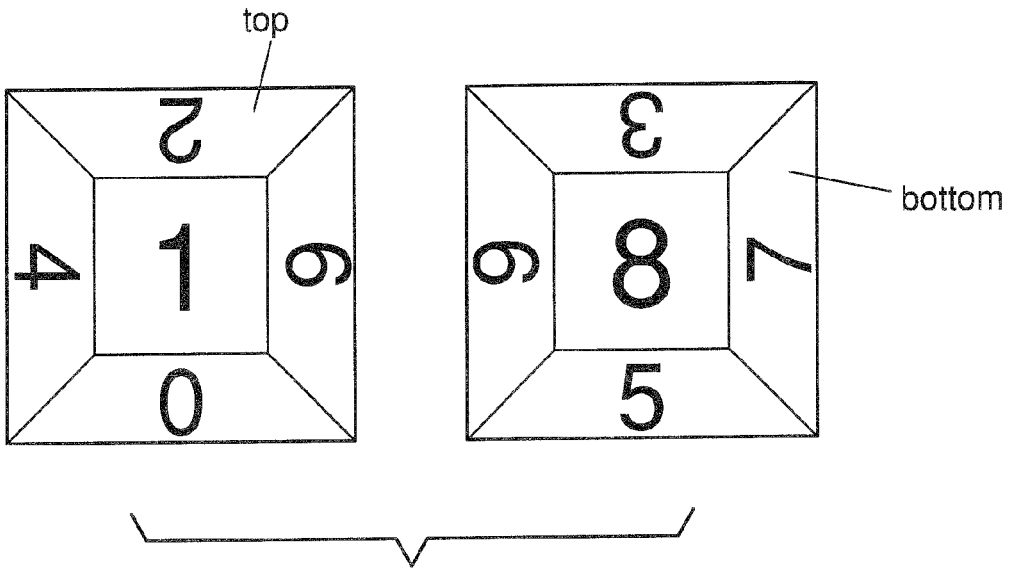
FIG. 5 is a detailed view of a numerical die of the present invention.

The game 100 further comprises a plurality of creature cards 130 forming a first deck of cards. As shown in FIG. 4, each creature card 130 has a front face labeled with at least a picture, a name, a card type, a rarity, an ability, and a spell symbol.

Figure 3:
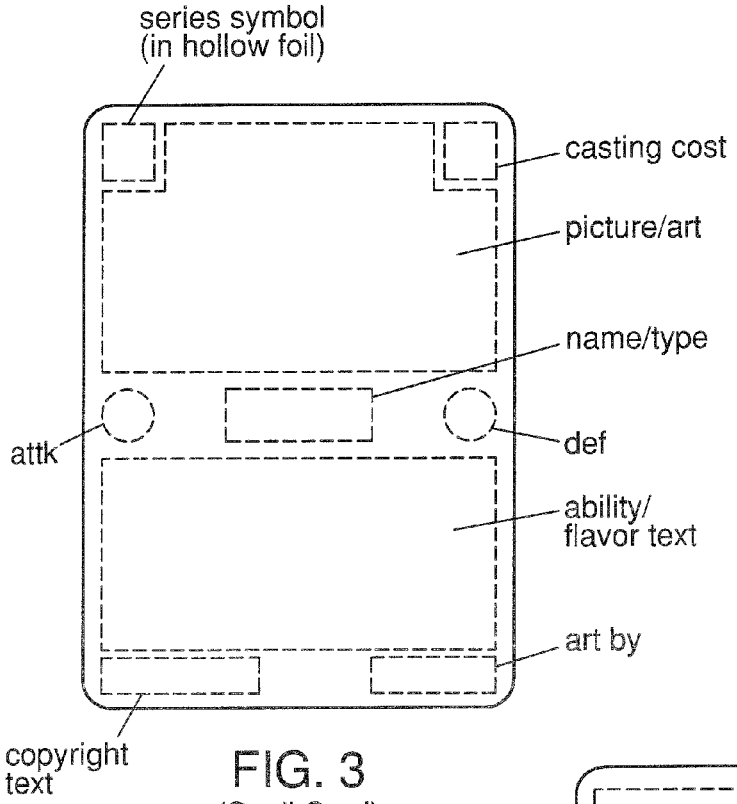
FIG. 3 is a detailed view of a spell card of the game of the present invention.

The game 100 further comprises a plurality of spell cards 140 forming a second deck of cards. As shown in FIG. 3, each spell card has a front face labeled with at least a picture, a name, an ability, a series symbol matching one symbol on the symbol dice 210, an attack, and a defense.

Game Mechanics

Each player has four dice (e.g., the two numerical dice 110 and the two symbol dice 210). The numerical dice 110 are used for multiplication. The player throws the numerical dice 110 and he/she multiplies the two numbers that appear on the dice 110. Depending on the product, the player can summon a creature to defend their life points. On a roll of 1 to 10 the player can bring out a low-level creature or common creature. Some common creatures have a casting cost of 6 or more so they are considered uncommon. With a roll of 12 to 20, you can summon a rare creature to the field. Ultimate Creatures must have at least one uncommon, rare, or two common level creatures in order for you to summon. Ultimate Creatures have a continuous ability and can roll their respective crescent to activate it. Rare creatures have one-time use ability; once the ability is used it can no longer be activated. Each faction contains one Secret Rare with a support rare. Secret Rare are limited to two per deck so you can only have two secret rare per type. Example: 2 secret rare creatures, 2 secret rare artifacts, 2 secret rare field cards, and 2 secret rare spell cards. The support rare, you can have 3 in a deck and can be recognized by a double coloring of purple and blue. In addition to Secret Rare there is one more rarity the rarity is known as unique, these cards are very limited in nature the characters that are produced are the main characters in each faction and are very powerful creatures that can be summoned when you roll the unique symbol on the dice. These unique cards will be in a separate deck. When a player rolls the dice and rolls the unique symbol he can then move the card from the deck into his hand he can instantly try to summon the unique creature from his hand. Common creatures have a low level ability but must be activated.

In some embodiments, the total number of cards is 45 (e.g., a 45 card minimum, e.g., 22 creature cards and 23 spell cards).

Player Turn Mechanics

First the player draws a card. Player then rolls for Monster summons. Then he rolls for special ability if applicable. Equip phase. Spell phase. Battle phase. Resolution phase.

Summoning

Monsters that are summoned cannot attack during the turn they are summoned. In addition monsters cannot use their abilities on the turn they are summoned for the first time. There is no limit to the monsters you can summon.

Multiple Summoning

Multiple summoning can be performed if you have anything left over from your multiplication. For instance, let's say you roll a 24 and don't have an ultra rare card that you can summon but you have two creatures with 6 in their casting cost and another one with twelve you can summon all 3 creatures during that turn.

Abilities

Abilities are rolled for with two ten-sided dice. When a respective crest is rolled the ability is activated. If the player rolls a crest that does not belong to him the ability remains unused and the player cannot use it he or she must wait for their next turn to use the ability on that creature.

Attack

When a Player declares an attack, he chooses which monster to attack. The defense of the monster defending is subtracted. A player can still respond with a fast action spell card since the only requirement is to be able to answer the quiz question.

Spell Cards

Spell Cards will run in the Deck. Only requirement for spell cards is a quiz card trivia question in Championship mode. During a players turn, the player declares that he/she is going to try and play a spell; if he/she answers the quiz question correctly, the spell is activated. If he doesn't the spell is discarded. Spells will all be generalized. All factions can use spells. There are two types of spells: fast action spells and your turn spells. Fast action spells can be activated at any time and are marked with the glowing symbol for spells. Your turn spells have no makings but can only be played during your turn. There are also Field Spell cards which can only be used during your turn they also must be activated by rolling the appropriate number just like the artifacts. Each player has 30 seconds to answer the quiz question.

Before the game begins, both players set up their quiz decks and place them on the field where the quiz question decks belong. When player 2 wants to throw a spell, he answers a quiz question. Player 1 draws a card from his quiz deck then asks the question to player 2. If player 2 answers correctly, can cast his spell, if not spell is countered.

Equip cards can be equipped during your phase only, but the equipments ability must be rolled on in order to activate them. If the player rolls the product required for activation, the equip card is activated. On a roll of one or zero, the equip card is destroyed.

Game Modes

Standard Mode: In Standard mode no quiz questions are used to use spells. But spells are limited to 3 per turn. Championship Mode: Spells and all other applicable rules are used in game play.

The disclosures of the following U.S. Patents are incorporated in their entirety by reference herein: U.S. Pat. No. 1,855,543, U.S. Design Pat. No. D301556; U.S. Patent Application No. 2002/0043764; U.S. Patent Application No. 2006/0220317; U.S. Patent Application No. 2009/0295092; U.S. Patent Application No. 2010/0003649.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A game comprising:

(a) two numerical dice (110), each numerical die (110) having ten faces, each face labeled with a number such that each numerical die has a face labeled with each 0, 1, 2, 3, 4, 5, 6, 7, 8, and 9;

(b) two symbol dice (210), each symbol die (210) having ten faces, each face labeled with a symbol;

(c) a plurality of creature cards (130) forming a first deck of cards, each creature card has a front face labeled with at least a picture, a name, a card type, a rarity, an ability, and a spell symbol; and (d) a plurality of spell cards (140) forming a second deck of cards, each spell card has a front face labeled with at least a picture, a name, an ability, a series symbol matching one symbol on the symbol dice (210), an attack, and a defense.

2. The game of claim 1, wherein a symbol is selected from the group consisting of an infinity symbol, a positive symbol, a negative symbol, an omega symbol, and a unique symbol.

* * * * *